US011974644B2

(12) United States Patent
Greenswag

(10) Patent No.: US 11,974,644 B2
(45) Date of Patent: May 7, 2024

(54) CONFIGURABLE TOWEL/BAG ASSEMBLY

(71) Applicant: Jeffrey S Greenswag, Denver, CO (US)

(72) Inventor: Jeffrey S Greenswag, Denver, CO (US)

(73) Assignee: Sauce Golf Co, LLC, Denver, CO (US)

( * ) Notice: Subject to any disclaimer, the term of this patent is extended or adjusted under 35 U.S.C. 154(b) by 145 days.

(21) Appl. No.: 17/826,329

(22) Filed: May 27, 2022

(65) Prior Publication Data

US 2022/0378161 A1 Dec. 1, 2022

Related U.S. Application Data

(60) Provisional application No. 63/195,569, filed on Jun. 1, 2021.

(51) Int. Cl.

| | |
|---|---|
| ***A45C 9/00*** | (2006.01) |
| ***A45C 3/10*** | (2006.01) |
| ***A45C 13/10*** | (2006.01) |

(52) U.S. Cl.

CPC ..... *A45C 9/00* (2013.01); *A45C 3/10* (2013.01); *A45C 13/103* (2013.01)

(58) Field of Classification Search

CPC ..... A45C 9/00; A45C 3/10; A45C 13/103

USPC ..... 383/4

See application file for complete search history.

(56) References Cited

U.S. PATENT DOCUMENTS

| | | | | |
|---|---|---|---|---|
| 3,052,895 A * | 9/1962 | Salvatore | A47G 9/086 383/111 |
| 4,723,300 A * | 2/1988 | Aranow | A45C 7/00 383/4 |
| 2010/0050359 A1* | 3/2010 | Brown | A45C 11/24 15/210.1 |

FOREIGN PATENT DOCUMENTS

FR 2568756 A1 * 2/1986

OTHER PUBLICATIONS

Machine translation of FR-2568756-A1.*

* cited by examiner

*Primary Examiner* — Jes F Pascua

(74) *Attorney, Agent, or Firm* — Justin Lampel

(57) ABSTRACT

A configurable towel/bag assembly is provided. The configurable towel/bag is especially suitable for both acting like a towel and for converting into a bag orientation for holding items in a cool environment while still maintaining separate use of the towel if desired. The towel/bag assembly may comprise a first surface and a second surface. The first surface may be a moisture-absorbing surface (the "towel" surface) and the second surface may be a moisture-resistant surface. Preferably the first and second surfaces are permanently secured together; however, in one embodiment, the first and second surfaces may be selectively removed from each other for independent use of each surface. In one embodiment, a rough area of the apparatus allows for the scrubbing and cleaning golf balls and golf clubs.

15 Claims, 6 Drawing Sheets

CONFIGURABLE TOWEL/BAG ASSEMBLY

CROSS REFERENCE TO RELATED APPLICATIONS

The following application is based on and claims the priority benefit of U.S. provisional application Ser. No. 63/195,569 filed Jun. 1, 2021; the entire content of which is incorporated by reference.

BACKGROUND OF THE INVENTION

A configurable towel/bag assembly is provided. The configurable towel/bag is especially suitable for both acting like a towel and for converting into a bag orientation for holding items in a cool environment while still maintaining separate use of the towel if desired. The towel/bag assembly may comprise a first surface and a second surface. The first surface may be a moisture-absorbing surface (the "towel" surface) and the second surface may be a moisture-resistant surface. Preferably the first and second surfaces are permanently secured together; however, in one embodiment, the first and second surfaces may be selectively removed from each other for independent use of each surface. In one embodiment, a rough area of the apparatus allows for the scrubbing and cleaning golf balls and golf clubs.

Towels having unique features are common. For example, U.S. Pat. No. 9,671,165 to Quinn discloses a weighted towel with handles manufactured from an absorbent material having weights near or at one end which allows a person with limited mobility, dexterity or range of motion to have the ability to dry himself; the end having hook and loop fasteners which attach and allow the end to wrap around a body extremity to dry areas of a limb which are difficult to reach or touch, where the weights are heavy material enclosed in a tough, flexible bag that allows the weight to conform to the limb, or the foot and toes when pressed against.

Further, U.S. Pat. No. 9,162,125 to McBryde discloses a multi-use golf towel having an absorbent front layer, a back layer being chamois, and a moisture barrier inner layer disposed therebetween to keep the front layer dry, a removable rotating golf brush with wire and nylon bristles disposed in a frame within the towel, and a ring to accept a hanging device to attach the towel to a golf bag. A cover disposed on a back side of the frame to protect the bristles.

Still further, U.S. Pat. No. 5,761,761 to An discloses a tri-sectioned multi-purposed golf towel having two sides of fabric, one side preferably being made of an absorbent material such as terry cloth, and the other side made of a more coarse material, wherein the rectangular towel is divided into three longitudinal sections of equal width, first, second and third longitudinal sections. The first longitudinal section is folded over the second longitudinal section, and then the third longitudinal section is folded over the first longitudinal section. The ends of the towel are secured by binding strips to prevent fraying of the towel. The upper end of the trifolded towel is then stitched transversely. Adjacent to the permanently bound end, preferably centrally disposed on one of the outer faces of the towel, is a circular looping patch which corresponds to a circular hooking patch which is located on the outer face of the towel as well. A hooking member with a hooking patch which corresponds to the looped patch of the towel allows the towel to be hung in various places.

However, these patents fail to describe a configurable towel/bag assembly having the features described herein which are easy to use and convenient.

SUMMARY OF THE INVENTION

A configurable towel/bag assembly is provided. The configurable towel/bag is especially suitable for both acting like a towel and for converting into a bag orientation for holding items in a cool environment while still maintaining separate use of the towel if desired. The towel/bag assembly may comprise a first surface and a second surface. The first surface may be a moisture-absorbing surface (the "towel" surface) and the second surface may be a moisture-resistant surface. Preferably the first and second surfaces are permanently secured together; however, in one embodiment, the first and second surfaces may be selectively removed from each other for independent use of each surface. In one embodiment, a rough area of the apparatus allows for the scrubbing and cleaning golf balls and golf clubs.

An advantage of the present configurable towel/bag assembly is that the present configurable towel/bag assembly may have alternative surfaces for cleaning different objects, including a rough surface for scrubbing.

Another advantage of the present configurable towel/bag assembly is that the present configurable towel/bag assembly, in one embodiment, may separate into two pieces, leaving the first surface (the "towel" surface) to be used as a traditional golf towel, while the second surface may be folded and secured into a "bag" orientation for carrying objects such as canned drinks.

An advantage of the present configurable towel/bag assembly is that, in one embodiment, the present configurable towel/bag assembly may have two distinct absorbing materials incorporated into the moisture-absorbing surface.

Still another advantage of the present configurable towel/bag assembly is that the present configurable towel/bag assembly, in one embodiment, may separate into two pieces, leaving the towel surface to be used as a traditional golf towel, while the second surface may be pulled or placed over golf clubs or a golf bag in inclement weather to protect the golf clubs and/or golf bag.

Yet another advantage of the present configurable towel/bag assembly is that the present configurable towel/bag assembly may be machine washable.

An advantage of the present configurable towel/bag assembly is that the present configurable towel/bag assembly may be used as a golf cart seat cover.

And yet another advantage of the present configurable towel/bag assembly is that the present configurable towel/bag assembly may be used as a reusable grocery bag, a shoe bag, or a bag to hold practice balls.

And still another advantage of the present configurable towel/bag assembly is that the present configurable towel/bag assembly may have an insulation layer located between two layers of the moisture resistant surface to better insulate items being stored within the device. Further, the insulation layer may provide the assembly with a weather-proof liner.

Still another advantage of the present configurable towel/bag assembly is that the towel may remain damp (if soaked in water) and protected from evaporation as a result of the towel remaining substantially within the protected outer moisture-resistant layer of the assembly.

And another advantage of the present configurable towel/bag assembly is that the present device may allow a user to have a substantially moist area and substantially dry area of the towel as a result of soaking a portion of the moisture-absorbing surface in water.

For a more complete understanding of the above listed features and advantages of the present configurable towel/bag assembly reference should be made to the detailed description and the drawings. Further, additional features and advantages of the invention are described in, and will be apparent from, the detailed description of the preferred embodiments.

DETAILED DESCRIPTION OF THE PREFERRED EMBODIMENTS

A configurable towel/bag assembly is provided. The configurable towel/bag is especially suitable for both acting like a towel and for converting into a bag orientation for holding items in a cool environment while still maintaining separate use of the towel if desired. The towel/bag assembly may comprise a first surface and a second surface. The first surface may be a moisture-absorbing surface (the "towel" surface) and the second surface may be a moisture-resistant surface. Preferably the first and second surfaces are permanently secured together; however, in one embodiment, the first and second surfaces may be selectively removed from each other for independent use of each surface. In one embodiment, a rough area of the apparatus allows for the scrubbing and cleaning golf balls and golf clubs.

Figure 1:
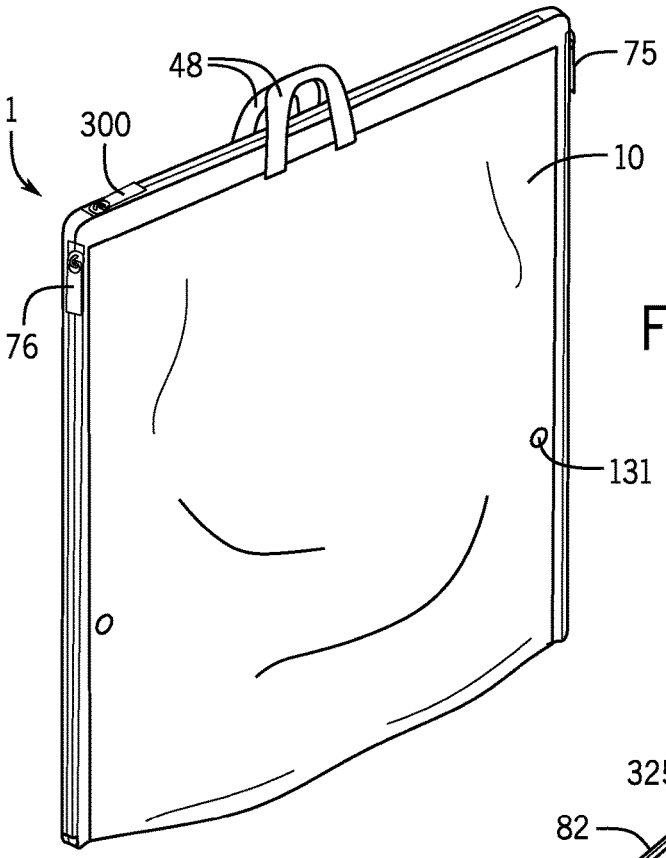
FIG. 1 illustrates a perspective view of the exterior of the configurable towel/bag assembly in the folded orientation wherein the exterior of the moisture-resistant surface is shown.

Referring first to FIG. 1, in an embodiment, a configurable towel/bag assembly 1 is provided. The towel/bag assembly 1 is especially suitable for both providing a drying and a moist surface for a person, depending on the desired use of the device. The towel/bag assembly 1 may allow a user to convert the assembly 1 into various configurations, including a bag, a cooler, a towel, a tube, a partial tube, or a combination thereof.

In an embodiment, the towel/bag assembly 1 may have a moisture-resistant surface 10 and a moisture-absorbing surface 50. The moisture-resistant surface 10 may be made of, in one embodiment, a polyester oxford woven nylon with a polyurethane coating. The moisture-absorbing surface 50 may act as a towel and may be made of, in one embodiment, a polyester microfiber material. In an embodiment, the assembly 1 may be selectively converted between the flat orientation of FIG. 2 and the folded bag/cooler orientation of FIG. 3. In the folded orientation of FIG. 3 the assembly 1 may hold objects, such as golf accessories, food, canned drinks, ice, water or the like and may further act as a protective rain cover for golf clubs.

In an embodiment, a handle 48, preferably attached to the moisture-resistant surface 10, may allow a user to carry and use the folded device as a bag. Further, the handle 48 may allow a user to connect the device to, for example, a golf bag to cover the golf bag, especially during inclement weather. In the preferred embodiment, the exterior of the moisture-resistant surface 10 has two handles 48 on opposing ends of the moisture-resistant surface 10, as shown in the figures.

As stated above, the moisture-resistant surface 10 may have a top portion 112 and a bottom portion 113. The bottom portion 113 of the moisture-resistant surface 10 may a first side 51 and a second side 52. The top portion 112 of the moisture-resistant surface 10 may have a first side 81 and a second side 82. A first zipper 75 having a track may extend along the entire length of the first side 51 of the bottom portion 113 of the moisture-resistant surface 10 and a second zipper 76 may extend along the entire second side 52 of the bottom portion 113 of the moisture-resistant surface 10. The first zipper 75 may connect to a first zipper track 85 and the second zipper 76 may connect to a second zipper track 86, both of which zipper tracks 85,86 are on the sides 81, 82 of the top portion 112 of the moisture-resistant surface 10. In the flat orientation of FIG. 1, the zippers 75, 76 of the bottom portion 113 are not secured to the tracks 85,86 of the top portion 112.

Figure 2:
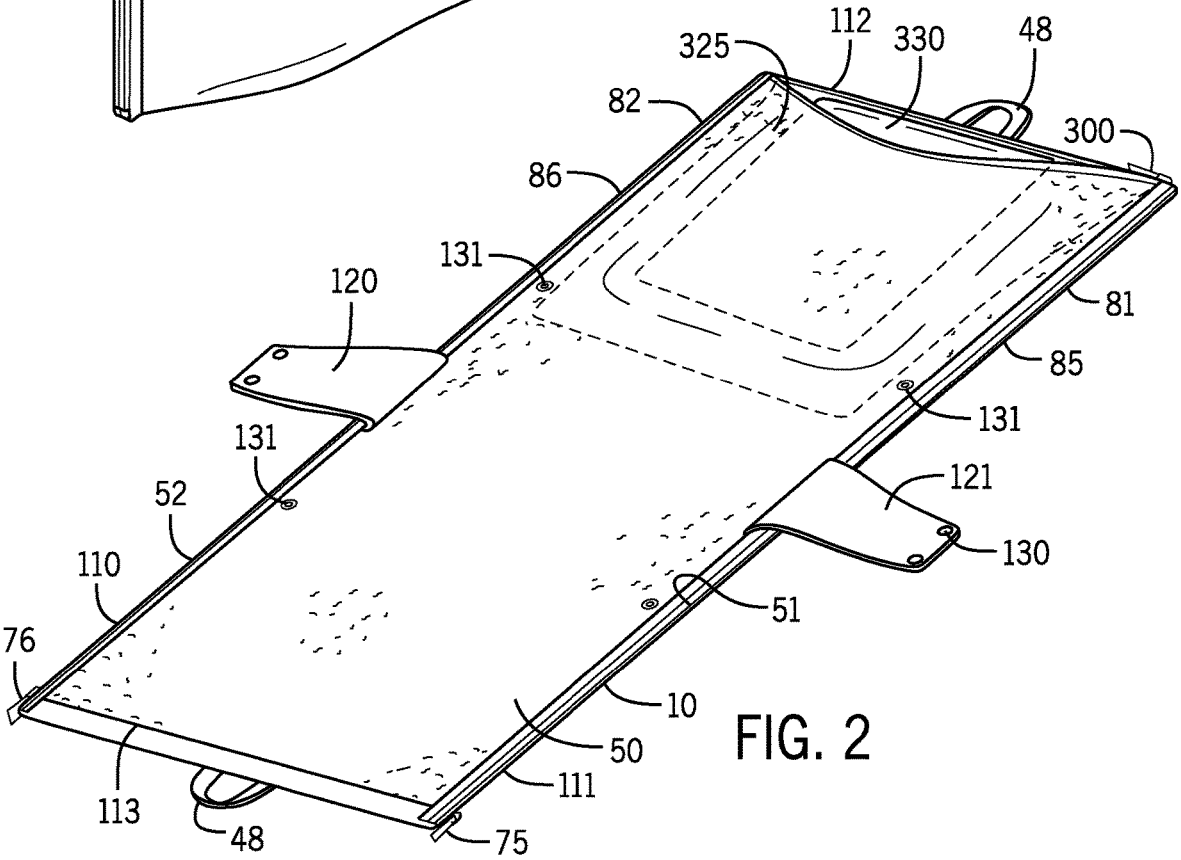
FIG. 2 illustrates a perspective view of the configurable towel/bag assembly in the flat orientation wherein towel surface is shown secured on top of the moisture-resistant surface.
Figure 3:
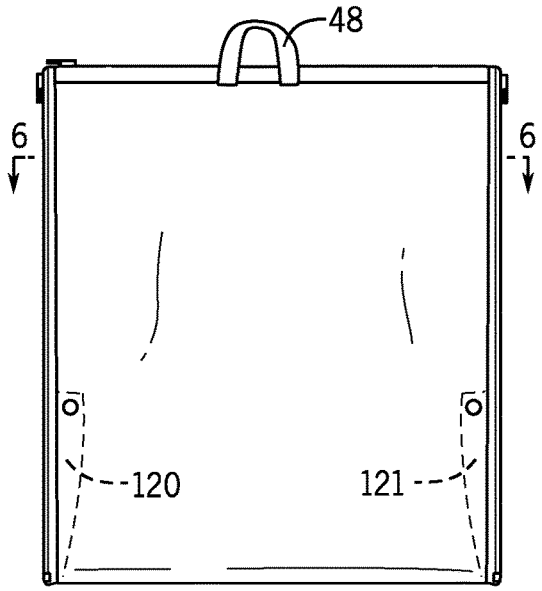
FIG. 3 illustrates a front view of the configurable towel/bag assembly in the folded orientation wherein the outside of the moisture-resistant surface is shown.

When the assembly 1 is folded from the flat orientation of FIG. 2 to the second (the "folded") orientation of FIG. 3 the assembly 1 may be used as a bag to carry items. To convert the assembly 1 back to the flat orientation, the reverse process is followed. In an embodiment, a user may elect to zip of half of the apparatus. More specifically, a user may elect to zip Zipper 75 along the track 85 of the moisture-resistant surface 10 while leaving zipper 76 unzipped to track 86. In this configuration, the assembly 1 may electively be used as a cover over, for example, a golf club bag.

In yet another embodiment (not shown) one zipper may be present on the top portion 112 of the moisture-resistant surface 10 and one zipper may be present on the bottom portion 113 of the moisture-resistant surface 10 wherein the two zippers in this embodiment are on opposing sides of the moisture-resistant surface 10. For example, zipper A might be located on bottom side 51 and zipper B might be located on top side 82 of the moisture-resistant surface 10. In this alternative embodiment, the zippers A, B may be used in connection with more than one track (for example, zipper 75 could be used on track 85 or along a track on side 52). As a result, a user may create various embodiments of the device 1 including creating a tube or half-tube.

Referring now to FIG. 2, in one embodiment, the moisture-resistant surface 10 of the assembly 1 may have a first corner flap 120 and/or a second corner flap 121 wherein the first corner flap 120 and the second corner flap 121 are located on sides 110, 111 of the moisture-resistant surface 10, approximately half-way between a top portion 112 and a bottom portion 113 of the moisture-resistant surface 10.

Figure 4:
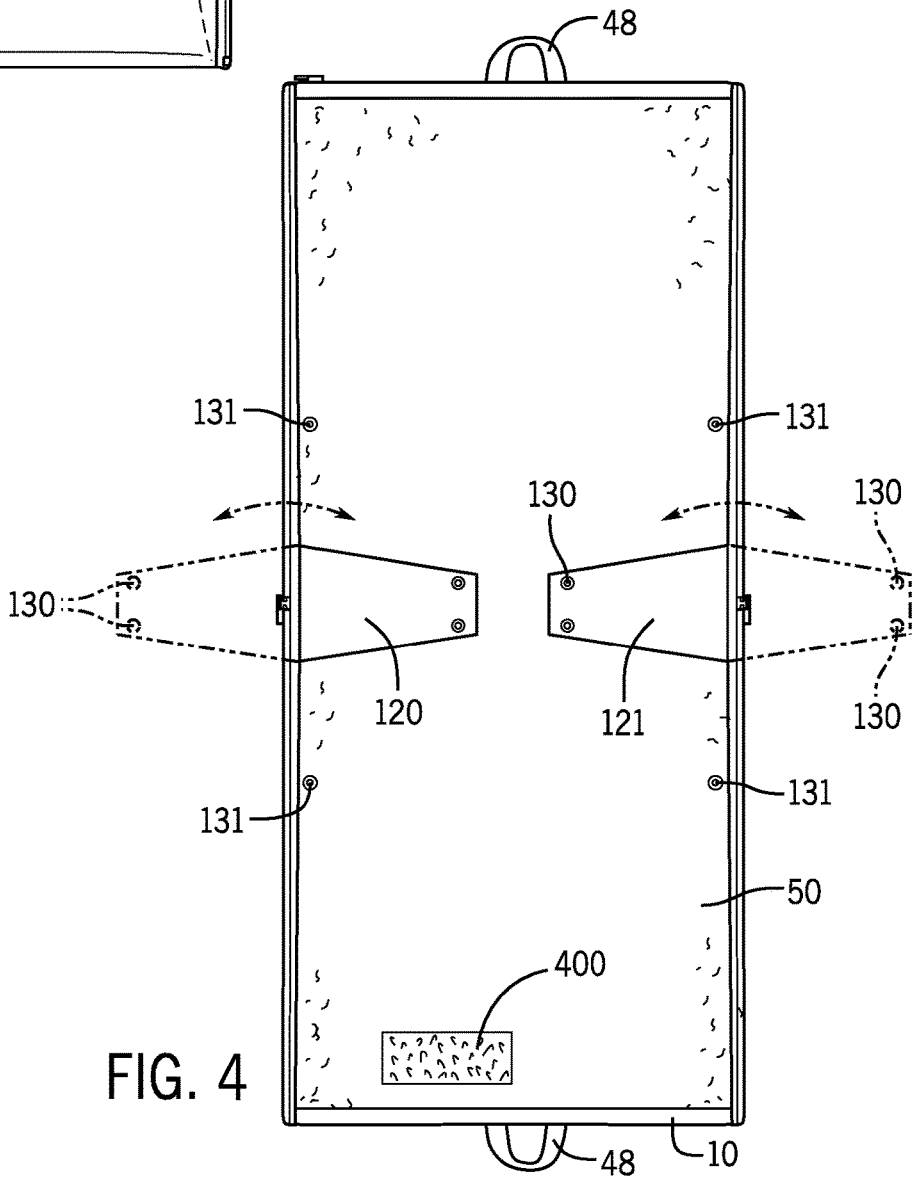
FIG. 4 illustrates an inside view of the configurable towel/bag assembly in the flat orientation wherein the towel surface is shown and wherein the corner flaps are shown folded inward with respect to the device.
Figure 5:
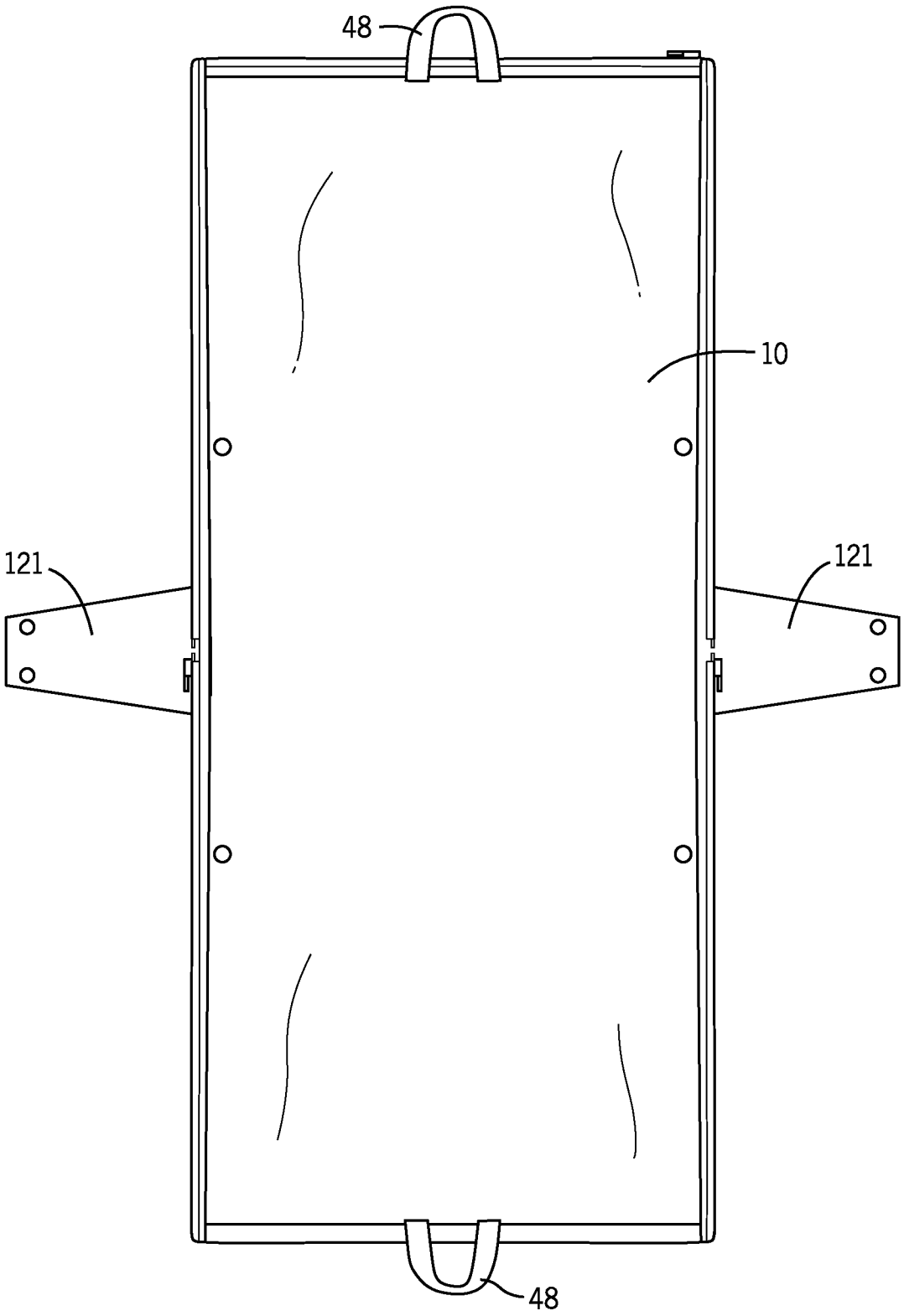
FIG. 5 illustrates an exterior view of the back of the configurable towel/bag assembly in the flat orientation wherein the corner flaps are shown folded outward with respect to the device.

The first flap 120 and the second flap 121 of the moisture-resistant surface 10 may be substantially same size and shape and may be in mirror orientation with respect to one another. The first and second flap 120, 121 may rotate between an outward orientation as shown in FIG. 2 to an inward orientation as shown in FIG. 4. Preferably, the corner flaps 120, 121 are trapezoidal in shape with the wide end directly secured to the sides 110, 111 of the moisture-resistant surface 10 so as to better prevent liquid leakage when the assembly 1 is folded into the bag orientation as discussed below.

Figure 6:
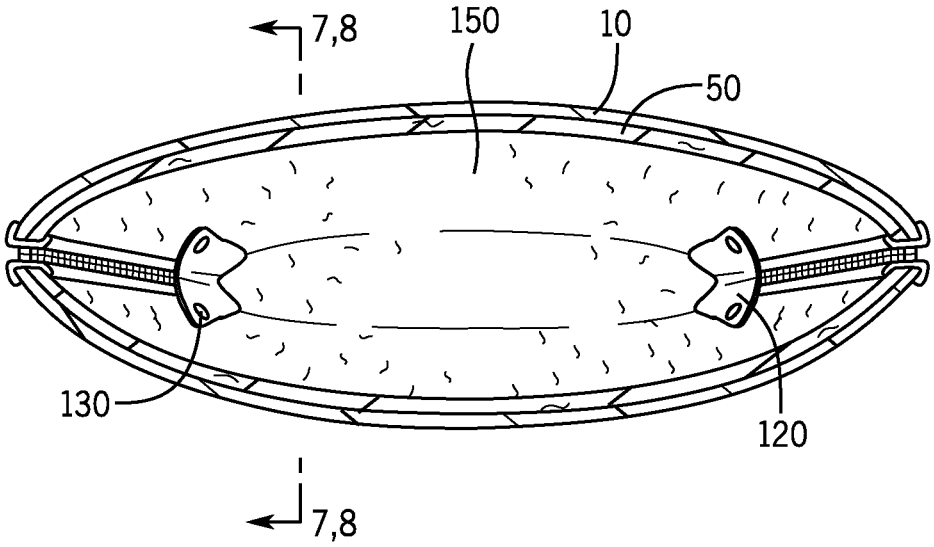
FIG. 6 illustrates a top view of the configurable towel/bag assembly in the folded orientation wherein the corner flaps are shown secured to the securing mechanisms for the corner flaps.
Figure 7:
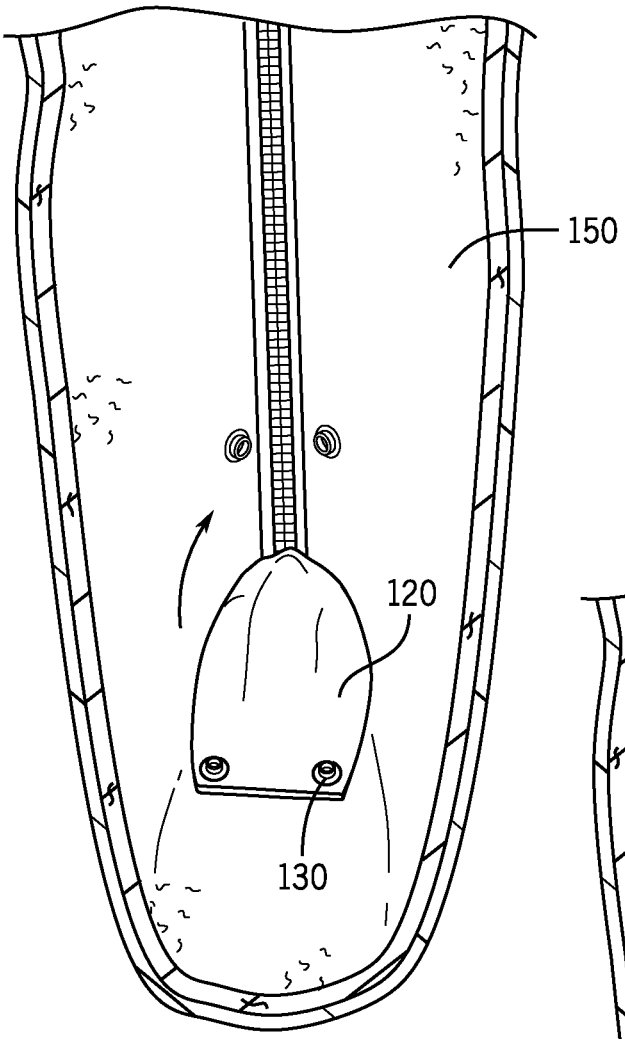
FIG. 7 illustrates a cross-sectional view of the interior of the configurable towel/bag assembly in the folded orientation wherein the corner flaps are shown rotating upward to the securing mechanisms for the corner flaps.
Figure 8:
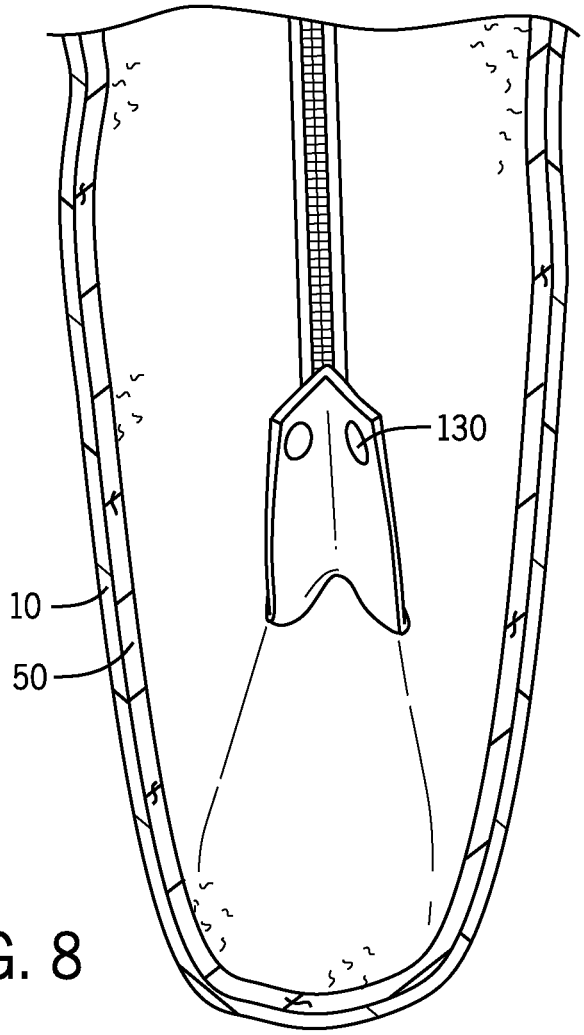
FIG. 8 illustrates a cross-sectional view of the interior of the configurable towel/bag assembly in the folded orientation wherein the corner flaps are shown fully secured to the securing mechanisms for the corner flaps.
Figure 9:
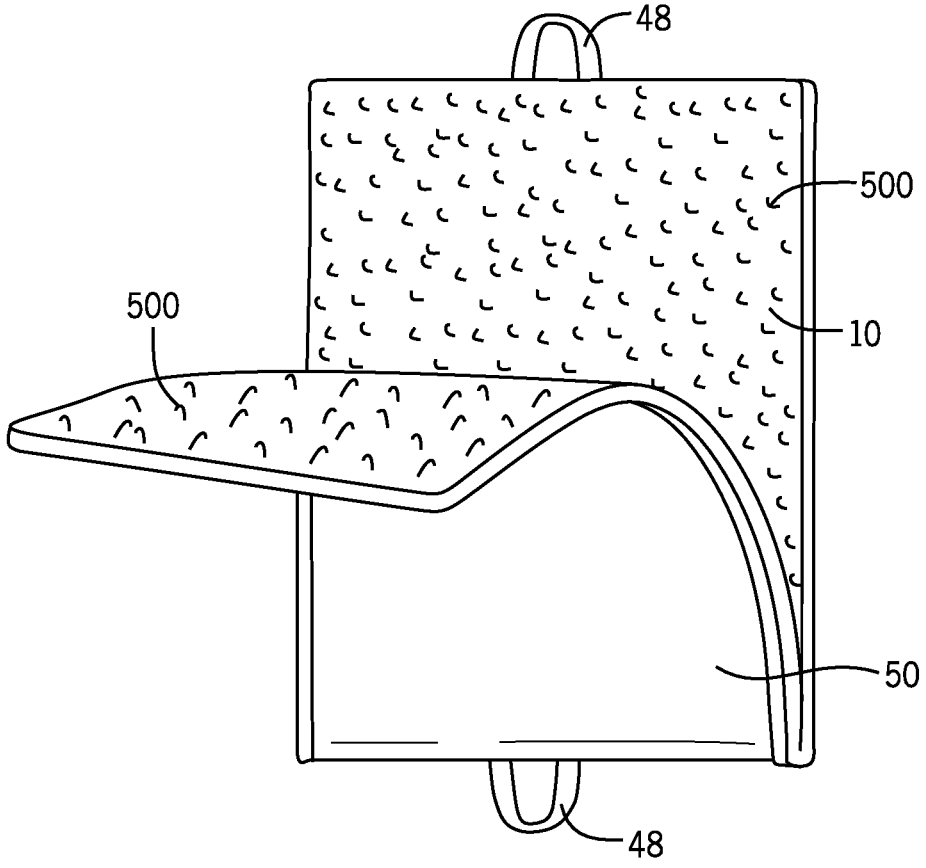
FIG. 9 illustrates an alternative embodiment wherein the moisture-resistant surface and the moisture-absorbing surface may be removed from each other and used independently.

When a user wishes to use the assembly 1 as a bag, the corner flaps 120, 121 are first rotated inward as shown in FIG. 4. The sides 110, 111 of the moisture-resistant surface 10 are then folded and secured together to form the bag orientation of FIG. 3. Once the sides 110, 111 of the moisture-resistant surface 10 are secured together, a user reaches into the interior 150 of the newly formed bag and secures grommets 130 on the securing flaps 120, 121 to grommet receivers 131 on the moisture-absorbing surface 50 to therein secure the corner flaps 120, 121 in an upward orientation within the interior 150 of the bag as shown in FIGS. 6-8. In one embodiment, the grommet receivers 131 are separated by the zipper (as shown in FIG. 7). This helps secure the device in the bag orientation. In the upward orientation, the corner flaps 120, 121 helps prevent leakage of liquids (such as melted ice) from the newly formed bag. The corner flaps 120, 121 also allow the water from melted ice inside the bag to be absorbed by the moisture-absorbing surface 50 as opposed to fully leaking out of the corners of the bag when folded. Further, in the upward orientation, the corner flaps 120, 121 may prevent rain from entering the interior 150 of the bag when the assembly 1 is in the folded bag/cooler orientation. More specifically, the first and second corner flaps 120, 121 act as seals to prevent liquids from leaking out the corners of the sides of the bag/cooler when the assembly 1 is in the bag/cooler orientation.

In an embodiment, a zipper 300 may be located at, near or just under the top edge of the top portion 112 of the moisture-resistant surface 10. The zipper 300 may split the moisture-resistant surface 10 into two layers (at an opening slit) which may therein form an internal pocket 325 within the interior of the moisture-resistant surface 10. An item, such as, for example, a cooling pack 330 may be placed within the internal pocket 325 to keep items located within the interior 150 of the bag cool. Further, in an embodiment, an insulation pack may be used instead of a cooling pack 300. Still further, the pocket 325 may be used to store personal items such as wallets and phones.

In one alternative embodiment, the moisture-absorbing surface 50 may have, for example, a localized rough area 400 for scrubbing objects. The localized rough area 400 may have, for example, bristles or another abrasive material which allows a user to clean dirt off of, for example, golf balls or other objects. In one embodiment, the localized rough area 400 is made of, for example, the hooks of a hook and loop fastener system.

In an embodiment the moisture-absorbing surface 50 and the moisture-resistant surface 10 may be electively removed from each other into two independent surfaces and used independently. In this embodiment, the two surfaces 10, 50 may be selectively secured together by, for example, a hook and loop fastener system 500. In an embodiment, buttons, zippers or other securing mechanisms may be used as opposed to the hook and loop fastener system.

Finally, in an embodiment, an underside of the moisture-absorbing surface 50 may have at least one strip of extra-absorbent material (such as a terry cloth). In particular, in this alternative embodiment, at least one (but preferably two) extra-absorbent surfaces or strips are incorporated into the moisture-absorbing surface 50 so that the moisture-absorbing surface 50 incorporates two distinct absorbing materials to allow the user to select the proper moisture-absorbing material to clean and dry different articles.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

I claim:

1. A configurable towel/bag assembly comprising:

a first surface having a top end, a bottom end, a first side and a second side forming a perimeter;

a second surface having a top end, a bottom end, a first side and a second side;

wherein the first surface is water-resistant;

wherein the second surface is water-absorbent;

wherein the first surface and the second surface are secured together and wherein the configurable towel/bag assembly moves from a first orientation wherein the configurable towel/bag assembly is flat to a second orientation wherein the configurable towel/bag assembly is folded into a bag orientation;

a first corner flap secured to the configurable towel/bag assembly wherein the first corner flap moves independent from the perimeter of the towel/bag assembly;

a second corner flap secured to the configurable towel/bag assembly wherein the second corner flap moves independent of the perimeter of the towel/bag assembly; and wherein the first corner flap and the second corner flap are located on opposing sides of the configurable towel/bag assembly and wherein the first corner flap and the second corner flap fold inward from a flat orientation located outside the perimeter of the configurable towel/bag assembly to a flat orientation located inside the perimeter of the configurable towel/bag assembly while the perimeter of the configurable towel/bag assembly remains unchanged; and wherein the first corner flap and the second corner flap are located between the top end and the bottom end of the first surface.

2. The configurable towel/bag assembly of claim 1 further comprising:

at least a first handle secured to the configurable towel/bag assembly.

3. The configurable towel/bag assembly of claim 1 further comprising:

a first zipper located on the first side of the first surface and a corresponding zipper track located on the first side of the first surface wherein the first zipper engages with corresponding zipper track and is capable of securing the configurable towel/bag assembly in a folded orientation.

4. The configurable towel/bag assembly of claim 1 further comprising:

a first securing mechanism located on the first corner flap;

a second securing mechanism located on the second corner flap;

a first corresponding securing mechanism receiving device located on the second surface wherein the first corresponding securing mechanism of the second surface receives the first securing mechanism and secures the first securing mechanism over a corner of the configurable towel/bag assembly when the configurable towel/bag assembly is folded into a bag orientation; and a second corresponding securing mechanism receiving device located on the second surface wherein the second corresponding securing mechanism of the second surface receives the second securing mechanism and secures the second securing mechanism over a corner of the configurable towel/bag assembly when the configurable towel/bag assembly is folded into a bag orientation.

5. The configurable towel/bag assembly of claim 4 wherein the first corner flap and wherein the second corner flap partially prevent a liquid from passing from the interior of the configurable towel/bag assembly while the towel/bag assembly is in the bag orientation.

6. The configurable towel/bag assembly of claim 1 further comprising:

a defined area of the second surface wherein the defined area has a scrubbing surface wherein the scrubbing surface is rougher than the remainder of the second surface area.

7. The configurable towel/bag assembly of claim 1 further comprising:

an opening slit at the top end of the first surface wherein the opening slit extends into an interior pocket and wherein the interior pock is capable of receiving an item.

8. The configurable towel/bag assembly of claim 7 further comprising:

a zipper at the opening slit wherein the zipper moves from a position of securing the opening slit in a closed position to a position of opening the opening slit and exposing the interior pocket.

9. A configurable towel/bag assembly comprising:

a first surface having a top end, a bottom end, a first side and a second side forming a perimeter;

a second surface having a top end, a bottom end, a first side and a second side;

wherein the first surface is water-resistant;

wherein the second surface is water-absorbent;

wherein the first surface and the second surface are temporarily and removably together and wherein the configurable towel/bag assembly moves from a first orientation wherein the configurable towel/bag assembly is flat to a second orientation wherein the configurable towel/bag assembly is folded into a bag orientation;

a first corner flap secured to the configurable towel/bag assembly wherein the first corner flap moves independent from the perimeter of the towel/bag assembly;

a second corner flap secured to the configurable towel/bag assembly wherein the second corner flap moves independent of the perimeter of the towel/bag assembly; and wherein the first corner flap and the second corner flap are located on opposing sides of the configurable towel/bag assembly and wherein the first corner flap and the second corner flap fold inward from a flat orientation located outside the perimeter of the configurable towel/bag assembly to a flat orientation located inside the perimeter of the configurable towel/bag assembly while the perimeter of the configurable towel/bag assembly remains unchanged; and wherein the first corner flap and the second corner flap are located between the top end and the bottom end of the first surface.

10. The configurable towel/bag assembly of claim 9 further comprising:

a securing mechanism on one side of the first surface; and a corresponding securing mechanism on one side of the second surface wherein the securing mechanism is capable of temporarily and removably securing the first surface to the second surface.

11. The configurable towel/bag assembly of claim 9 further comprising:

at least a first handle secured to the configurable towel/bag assembly.

12. The configurable towel/bag assembly of claim 9 further comprising:

a first securing mechanism located on the first corner flap;

a second securing mechanism located on the second corner flap;

a first corresponding securing mechanism receiving device located on the second surface wherein the first corresponding securing mechanism of the second surface receives the first securing mechanism and secures the first securing mechanism over a corner of the configurable towel/bag assembly when the configurable towel/bag assembly is folded into a bag orientation; and a second corresponding securing mechanism receiving device located on the second surface wherein the second corresponding securing mechanism of the second surface receives the second securing mechanism and secures the second securing mechanism over a corner of the configurable towel/bag assembly when the configurable towel/bag assembly is folded into a bag orientation.

13. The configurable towel/bag assembly of claim 12 wherein the first corner flap and wherein the second corner flap partially prevent a liquid from passing from the interior of the configurable towel/bag assembly while the towel/bag assembly is in the bag orientation.

14. The configurable towel/bag assembly of claim 9 further comprising:

a defined area of the second surface wherein the defined area has a scrubbing surface wherein the scrubbing surface is rougher than the remainder of the second surface area.

15. The configurable towel/bag assembly of claim 9 further comprising:

an opening slit at the top end of the first surface wherein the opening slit extends into an interior pocket and wherein the interior pock is capable of receiving an item.

* * * * *